US010550479B2

(12) United States Patent
Marmann et al.

(10) Patent No.: US 10,550,479 B2
(45) Date of Patent: Feb. 4, 2020

(54) METHOD OF THERMALLY TREATING BLACK PLATE COATED WITH A CONVERSION COATING

(71) Applicants: THYSSENKRUPP RASSELSTEIN GMBH, Andernach (DE); THYSSENKRUPP AG, Essen (DE)

(72) Inventors: Andrea Marmann, Piesport (DE); Tanja Lommel, Neuwied (DE); Reiner Sauer, Heimbach-Weis (DE); Tatjana Kasdorf, Andernach (DE); Martin Schleich, Saffing (DE); Monika Malejczyk, Rheinbrohl (DE); Hans-Peter Rink, Kaifenheim (DE)

(73) Assignees: THYSSENKRUPP RASSELSTEIN GMBH, Andemach (DE); THYSSENKRUPP AG, Essen (DE)

( * ) Notice: Subject to any disclaimer, the term of this patent is extended or adjusted under 35 U.S.C. 154(b) by 446 days.

(21) Appl. No.: 15/240,028

(22) Filed: Aug. 18, 2016

(65) Prior Publication Data

US 2017/0051413 A1 Feb. 23, 2017

(30) Foreign Application Priority Data

Aug. 21, 2015 (DE) ..... 10 2015 113 878

(51) Int. Cl.
*C25D 11/34* (2006.01)
*C23C 22/73* (2006.01)
(Continued)

(52) U.S. Cl.
CPC ..... *C23C 22/73* (2013.01); *C23C 22/05* (2013.01); *C23C 22/78* (2013.01); *C23C 22/82* (2013.01); *C25D 5/48* (2013.01); *C25D 11/34* (2013.01)

(58) Field of Classification Search
CPC ..... C23C 22/05; C23C 22/73; C23C 22/78; C23C 22/82; C25D 11/34; C25D 5/48
See application file for complete search history.

(56) References Cited

U.S. PATENT DOCUMENTS 6,287,704 B1 9/2001 Preikschat et al.
6,946,201 B2 9/2005 Preikschat et al.
(Continued)

FOREIGN PATENT DOCUMENTS

DE 10161383 8/2002
DE 102013107506 1/2015
(Continued)

OTHER PUBLICATIONS

Result of Examination Report for German Application DE 10 2015 113 878.6 filed Aug. 21, 2015.

*Primary Examiner* — Lois L Zheng
(74) *Attorney, Agent, or Firm* — Paul D. Bianco; Fleit Intellectual Property Law

(57) ABSTRACT

A method of thermally treating black plate which is coated with a conversion coating. The conversion-coated black plate is heated during a thermal treatment time from 0.1 seconds to 30 seconds to a temperature in the range of 240° C. to 320° C. The heat treatment makes it possible to improve the adhesion of the conversion coating to the black plate surface. In one application of the method, the heat treatment is carried out in a process for the production of corrosion-resistant black plate, in which prior to, during or after the heat treatment, an organic coating in the form of paint or a polymer coating is applied to the conversion coating of the black plate.

20 Claims, 6 Drawing Sheets

(51) Int. Cl.

| | |
|---|---|
| ***C23C 22/05*** | (2006.01) |
| ***C23C 22/82*** | (2006.01) |
| ***C23C 22/78*** | (2006.01) |
| ***C25D 5/48*** | (2006.01) |

(56) References Cited

U.S. PATENT DOCUMENTS

| | | | |
|---|---|---|---|
| 8,715,387 | B2 | 5/2014 | Irizarry et al. |
| 8,764,916 | B2 | 7/2014 | Donsbach et al. |
| 9,382,636 | B2 | 7/2016 | Portegies Zwart et al. |
| 2009/0155618 | A1* | 6/2009 | Sakakibara ..... C23C 22/73 428/628 |
| 2013/0183542 | A1 | 7/2013 | Portegies Zwart et al. |
| 2015/0024222 | A1 | 1/2015 | Sauer et al. |

FOREIGN PATENT DOCUMENTS

| | | |
|---|---|---|
| EP | 2532769 | 12/2012 |
| EP | 2625319 | 8/2013 |
| EP | 26253319 | 8/2013 |
| EP | 2926569 | 10/2015 |
| WO | 9740208 | 10/1997 |
| WO | 2008119675 | 10/2008 |

* cited by examiner

METHOD OF THERMALLY TREATING BLACK PLATE COATED WITH A CONVERSION COATING

FIELD OF THE INVENTION

The present invention relates to a method of thermally treating conversion-coated black plate as well as to the use of the method in the production of corrosion-resistant black plate.

BACKGROUND

To protect metal surfaces against corrosion, it is known to use methods in which a coating of a different and, as a rule, less noble metal (e.g., zinc and chromium) is applied to the metal surface. Thus, it is known, e.g., to coat steel with zinc or chromium or even with tin (which is, however, more noble than steel). In the production of packagings, in particular in the food industry, for example, tin-coated black plate (tinplate) is very extensively used. Tinplate has excellent corrosion resistance and good formability and weldability, which makes it highly suitable for use in the production of packagings, e.g., beverage cans.

In order to also protect the metal coating, for example, the tin coating for tinplate, against corrosion and to create a good base surface for paint and plastic coatings, conversion coatings are frequently applied to the surface of the metal coating.

Conversion coatings are defined to mean very thin, in most cases, inorganic, metal coatings on a metal surface, which, as a rule, are created by chemical reaction of an aqueous treatment solution with the metal substrate. In the no-rinse process, for example, these conversion coatings are applied by means of a roll coater or a spray coating system. Especially on black plate, conversion coatings ensure a highly effective protection against corrosion and a good base surface for paint and plastics, and they reduce surface friction and abrasion.

Depending on the substrate, a distinction is made between iron, zinc or manganese phosphating, electrolytic phosphating and chromate, oxalate and anodizing processes. Chromium-containing conversion coatings have been demonstrated to be highly effective in protection against corrosion. During chromating, the metal surface is treated with an acid solution containing chromium(VI) ions, in the course of which chromium(VI) is reduced to chromium(III). As a result of the treatment, a chromium-containing anti-corrosive coating forms on the metal surface.

Chromium(VI) compounds are, however, acutely toxic and carcinogenic. In the EU, the passivation of metal surfaces with chromium(VI)-containing substances has already been prohibited for use in the manufacture of automobiles and household appliances. For this reason, chromium-free conversion coatings have been developed in the state of the art. Thus, for example, methods of producing chromium-free conversion coatings on zinc and aluminum surfaces are known from WO 97/40208-A and EP 2532769 A1. Furthermore, WO 2008/119675 describes treatment solutions for producing chromium-free conversion coatings which contain oxo cations and complex halogen ions, which lead to colorless and slightly iridescent conversion coatings.

Tinplate has excellent properties as a packaging material for food products and has been produced and processed for many decades for this purpose. However, because of the global shortage of this resource, tin, which in tinplate is the corrosion-inhibiting coating, has become a relatively expensive material. As an alternative to tinplate, it is known from the prior art that it is possible to use electrolytically chromium-coated steel, especially for use as packaging steel, which is referred to as "Tin Free Steel," (TFS) or as "Electrolytic Chromium Coated Steel (ECCS)." On the one hand, these tin-free steels provide excellent adhesion for paints or organic protective coatings (for example, made of PP or PET), but, on the other hand, because of the toxic and harmful properties of the chromium(IV)-containing materials used in the coating, there are considerable disadvantages to using them in the process of applying the coating.

These disadvantages can be avoided when using the method of passivating black plate in coil form as known from DE 10 2013107506 A1. DE 10 2013107506 A1 offers the possibility of passivating black plate without the use of chromium-containing treatment solutions and thereby protecting it against corrosion. Black plate treated according to this method can be used as a substitute for tinplate and tin-free steel (TFS or ECCS), for example, in the production of metal packagings, such as cans. For use of black plate described in DE 10 2013107506 in the production of cans, the passivated black plate is coated at least on one surface with an organic coating, e.g., paint or polymer coatings made of PET, PP or PE or combinations thereof so as to improve the corrosion resistance. In the production of cans, the coated side forms the inside surface of the can which may come into contact with acidic components and must therefore be especially well protected against corrosion, but it is also possible to coat both sides so as also to protect the outside surface of the can against corrosion in a humid atmosphere.

However, it was found that organic coatings on this black plate do not adhere sufficiently well to the passivated black plate surface. Especially if the drying time is short enough to be measured only in seconds, as is standard in conventional coil coating processes in which black plate in the form of a coil moves at a coil rate of more 200 m/min, it was found that the organic coatings (paint or polymer coating) on the black plate surface passivated with a conversion coating do not sufficiently adhere to black plate during the subsequent forming process (for example, in deep drawing processes for the production of cans). Comparative experiments have shown that under the mechanical loads that prevail during forming processes, it is possible for the conversion coating to become detached from the steel surface of black plate. To improve the adhesion of organic coatings to the black plate surface which has been passivated with the conversion coating, DE 10 2013107506 A1 proposes that a bonding agent be used, which bonding agent is mixed into the treatment solution which is applied to the black plate surface to create the conversion coating. However, this is able to only improve the adhesion of the organic coating to the conversion coating, but does not prevent the conversion coating from detaching from the black plate surface when the mechanical load is high.

SUMMARY

Thus, a problem addressed by at some embodiments of the present invention is to make available a chromium-free packaging steel which is suitable both as a substitute for tin-free steel (TFS or ECCS) and as a substitute for tinplate and which, both with respect to corrosion resistance and with respect to adhesive capacity of organic coatings, such as paint or polymer coatings, should be comparable to tinplate or tin-free steel. Specifically, an objective of at least some embodiments of the present invention is to make available a method by means of which the adhesion of organic coatings to the steel substrate is improved.

This problem is solved by a method of thermally treating conversion-coated black plate so as to improve the adhesion of an organic coating. Preferred embodiments of the method are also disclosed.

According to the method disclosed by the present invention, conversion-coated black plate is subjected to a thermal treatment so as to improve the adhesion of the conversion coating and an organic coating which is applied to the conversion coating prior to, during or after the thermal treatment, with the black plate coated with the conversion coating being heated during a heat treatment time (t) of 0.1 seconds to 30 seconds to a temperature in the range of 240° C. to 320° C. or preferably during a heat treatment time (t) of 0.1 to 5 second to a temperature in the range of 280° C. to 310° C. The heat treatment time (t) especially preferred is in the range of 0.1 seconds to 1 second, during which the conversion-coated black plate is heated to a temperature in the range of 290° C. to 310° C. Heating is preferably carried out by induction.

Surprisingly, it was found that such a short thermal treatment of the black plate coated with the conversion coating can considerably improve the adhesion of the conversion coating and thus the adhesion of an organic coating to the surface of passivated black plate. The thermal treatment can also be carried out after an organic coating has been applied to the black plate surface which has been coated with the conversion coating, without the risk of damage to the organic coating by the comparatively high temperatures of the thermal treatment. This is attributable to the very short treatment time (t) of the thermal treatment which preferably takes fewer than 5 seconds and more preferably fewer than 1 second.

Based on comparative experiments and analyses, it was possible to demonstrate that in order to ensure good adhesion of an organic coating to the black plate surface, the thermal treatment should be carried out within a preferred working range, with this preferred working range in a temperature-time diagram being circumscribed by the profile of a maximum temperature Tmax (t) and a minimum temperature Tmin (t), said profile being dependent on the treatment time t, and with the time profile of the maximum temperature Tmax (t) and the minimum temperature Tmin (t) continuously decreasing as the treatment time t increases. In approximate terms, the curves of the time profile of the maximum temperature Tmax (t) and the minimum temperature Tmin (t) can be described by a linear function or a polynomial of higher degree, especially by a quadratic function. By limiting the thermal treatment time to short treatment times in the preferred range of 0.1 to 5 seconds or more preferably to less than 1 second as disclosed by the present invention, the thermal treatment of black plate in the form of a coil moving at a given coil speed can be carried out using the coil coating process, with the coil speeds in conventional coil coating processes being typically above 30 m/min.

In the coil coating process, first, for example, an aqueous and preferably chromium-free treatment solution is applied to the moving black plate coil so as to produce the conversion coating, which solution is subsequently allowed to dry. Subsequently, the moving black plate coil coated with the conversion coating is subjected to a thermal treatment according to the present invention. The thermal treatment can be carried out inside or outside a coating line in which an organic coating is applied to the black plate, said thermal treatment preferably being carried out while the black plate coil is moving, by passing the black plate coil at the predefined coil speed, for example, through a floating furnace and/or through an induction furnace.

In a preferred embodiment of the method according to the present invention, the thermal treatment is carried out in two steps while the coil is moving, with the first step providing for the heating of the conversion-coated black plate during a treatment time (t) from 10 seconds to 20 seconds to temperatures of approximately 240° C. and the second step providing for heating of the conversion-coated black plate briefly during a treatment time (t) from 0.1 to 0.5 seconds to a temperature in the range of 280° C. to 310° C. and preferably to a temperature in the range of 290° C. to 310° C.

At a predefined length of the furnaces used (for example, a floating furnace and/or an induction furnace), the treatment times to be adhered to during the thermal treatment according to the present invention can be controlled by the coil speed.

The thermal treatment according to the present invention ensures good adhesion of the conversion coating to the black plate surface sufficient to prevent detachment of the conversion coating when black plate coated with the conversion coating is subjected to a forming process. To avoid overdrying, on the one hand, and underdrying, on the other, during the thermal treatment, the thermal treatment according to the present invention is preferably carried out within a predefined working range in the temperature-time diagram (treatment temperature T as a function of the treatment time t), which allows a specific operating point (selected treatment temperature T and selected treatment time t) to be selected within the predefined working range depending on the coil speed of the moving black plate coil and depending on the composition of the conversion coating and the organic coating. In a temperature-time diagram T(t), the predefined working range is circumscribed by the time profile of the graphs of a maximum temperature Tmax (t) and a minimum temperature Tmin (t).

Within the short treatment time in the range of up to 10 seconds, as preferred according to the present invention, the profile of the dependence of the maximum temperature (Tmax) on the treatment time (t) is at least approximately linear. The dependence of the maximum temperature (Tmax) on the treatment time (t) can be expediently and approximately described by the equation Tmax (t)=310° C.−t*(° C./s), where t denotes the length of the treatment time of 0≤t 10≤s. Within the short range of treatment times t of a maximum of 10 seconds, the profile of the dependence of the minimum temperature (Tmin) on the treatment time (t) is at least approximately linear and can be can be expediently and approximately described by the equation Tmin (t)=290° C.−2 t*(° C./s)*(° C./$s^2$), where t stands for the length of the treatment time in the range of 0≤t≤10 seconds. At very short treatment times tin the range below 1 second, which are used, for example, during heating in a short induction furnace and at high coil speeds in the range of >30 m/min, the (narrow) working range between the minimum temperature (Tmin) and the maximum temperature (Tmax) is located at approximately 290° C. to 310° C. At longer treatment times, the temperature working range between the minimum temperature (Tmin) and the maximum temperature (Tmax) increases and at a treatment time t of 10 seconds, for example, is located between approximately 270° C. and 300° C. and at a treatment time t of 60 seconds, for example, between approximately 200° C. and 260° C.

The heat treatment according to the present invention can be used in a process for the production of corrosion-resistant black plate, in which production process first a conversion coating is applied to at least one black plate surface and the conversion-coated black plate is subsequently subjected to a heat treatment according to the present invention. The black plate preferably has the form of a coil, and both the application of the conversion coating and the heat treatment are carried out while the coil is moving at a predefined coil speed of preferably more than 30 m/min, and more preferably, more than 100 m/min. After the thermal treatment (heat treatment), an organic coating, e.g., in the form of paint or a polymer coating, is applied to the conversion coating, with the paint application or the polymer coating preferably being carried out by means of coil coating while the coil is moving. The thermal treatment according to the present invention can also be carried out during or after application of the organic coating.

If the organic coating is a thermoplastic synthetic material which is to be applied in molten or heat-softened form to the conversion coating, it is recommended that the thermal treatment be carried out immediately prior to or during application of the organic coating since melting or heat-softening the thermoplastic synthetic material in any case requires that the black plate be heated to temperatures above the melting temperature of the synthetic material and since, for example, the melting temperature of PET at 240° C. is within the working range of the method according to the present invention. It is also possible to carry out the thermal treatment in two or more steps, for example, in a first step as a thermal pre-treatment and in a second step as a thermal post-treatment prior to or after application of the organic coating to the conversion coating.

As a general rule, the thermal treatment of conversion-coated black plate according to the present invention can be carried out either as a pre-treatment prior to, or as a post treatment after, application of an organic coating to the conversion coating or even during application of the organic coating.

The organic coating can be produced, for example, by application of PE, PP or a polyester, preferably PET, as a coating. The organic coating can be applied by laminating a polymer film, in particular a PET film, or by directly extruding a molten thermoplastic synthetic material, such as PP or PE, onto one or both black plate surfaces.

The organic coating can also be produced by application of an organic paint, in particular an Organosol- and/or epoxy phenol- and/or polyester-based paint (as white or gold varnish).

In the process for the production of corrosion-resistant black plate, it is recommended that the starting material be uncoated black plate in the form of a coil made from cold-rolled, annealed and temper-rolled steel with a carbon content from 20 to 1,000 ppm. In a first processing step, after degreasing and pickling, the black plate surface is rendered inert by means of an electrochemical treatment (i.e., a corrosion-resistant surface is produced), it is subsequently rinsed with water, and in a second processing step, it is finally coated with a corrosion-resistant conversion coating in that an aqueous and chromium-free treatment solution is applied to at least one black plate surface. The electrochemical treatment in the first processing step is carried out, for example, by passing the black plate through an alkaline electrolytic bath and by connecting the black plate as an anode.

The aqueous treatment solution is preferably chromium-free and preferably comprises at least one of the following components:

- metal components: selected from the group comprising Ti, Zr, Mn, Zn, P and combinations thereof, in particular (complex) fluorides of these metals;
- organic components: selected from the group comprising polyacrylate, polycarboxylate and combinations thereof.

Especially preferred components of the aqueous treatment solution are Ti and/or Zr. After application of the aqueous treatment solution, the black plate to which the treatment solution has been applied is dried by heating the black plate during a drying time of, e.g., a maximum of 5 seconds to a drying temperature of a maximum of 200° C. After drying, the aqueous treatment solution coats the black plate surface in the form of a dry coating layer, with the dry coating layer of the treatment solution which forms the conversion coating preferably having a surface coverage between 25 and 150 $mg/m^2$. In a treatment solution containing titanium or zirconium, the dry layer preferably contains between 5 and 30 $mg/m^2$ of Ti or Zr.

BRIEF DESCRIPTION OF THE DRAWINGS

Additional properties, features and advantages of the method according to the present invention follow from the implementation examples described below with reference to the drawings. The drawings show.

DETAILED DESCRIPTION

Figure 1:
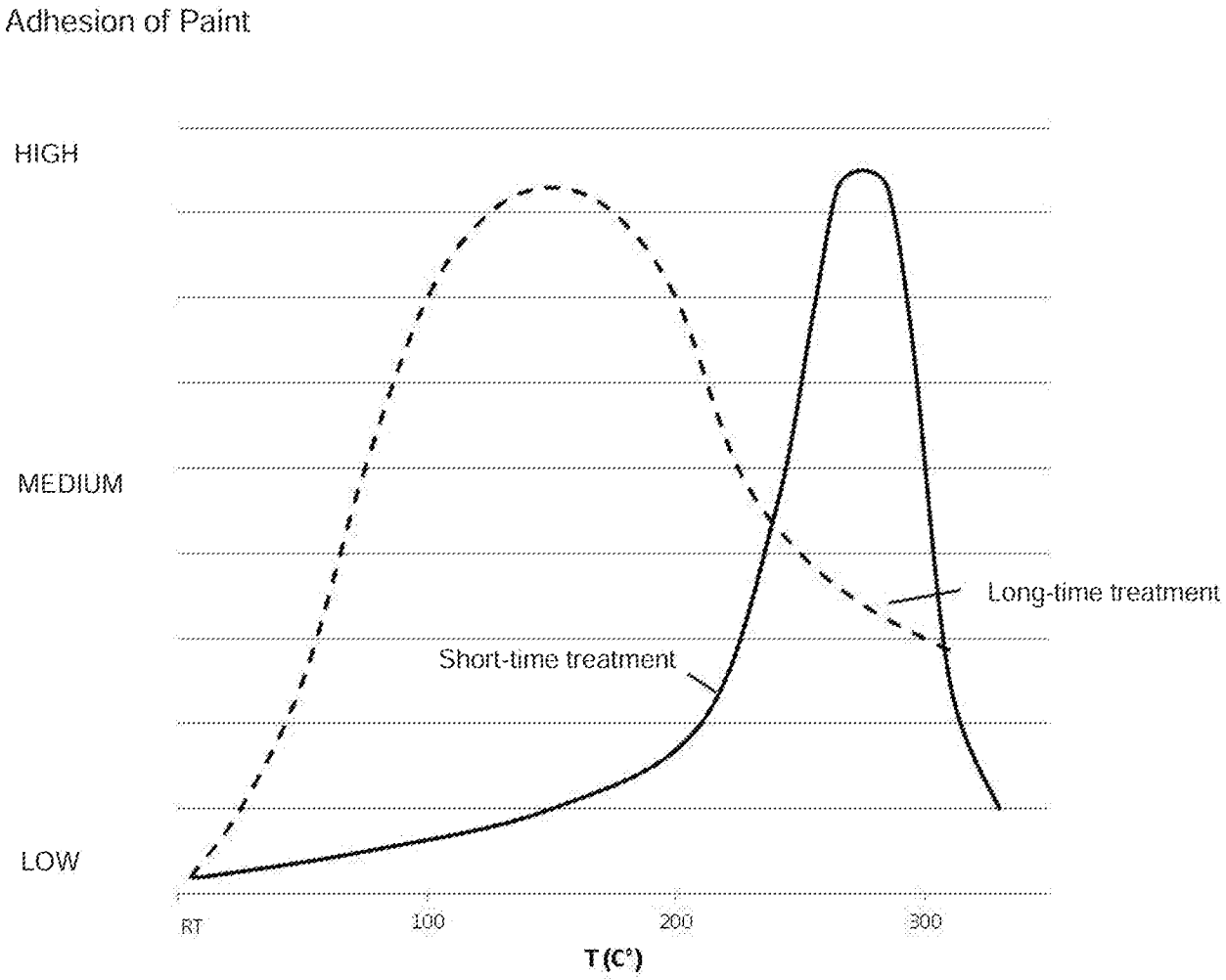
FIG. 1: A graphical representation of the quality of adhesion of paint to the surface of black plate coated with a conversion coating after different heat treatments prior to application of paint as a function of the temperature of the heat treatment.

The starting material used in the method according to the present invention is black plate which is coated with a conversion coating. According to the invention, this black plate is subjected to a thermal treatment (heat treatment) so as to improve the adhesion of an organic coating to the black plate, in particular paint or a polymer coating. Surprisingly, it was found that the heat treatment according to the invention is able to substantially improve the adhesion of the conversion coating to the black plate surface (steel coil). This reduces the risk that the conversion coating to which an organic coating has been applied may detach from the surface during the forming of the coated black plate.

DE 10 2013 107 506 A1 describes a process for the production black plate which is coated with a conversion coating. DE 10 2013 107 506 A1 is hereby expressly referenced and the content disclosed therein is hereby expressly incorporated by reference into the subject matter of this application. In the process described in DE 10 2013 107 506 A1, a chromium-free conversion coating is applied to black plate using a two-step process, wherein, in a first step, an electrochemical treatment of the black plate is carried out in an electrolytic bath, and in a second step, after rinsing the electrochemically treated black plate, a chromium-free treatment solution is applied to at least one surface of the electrochemically treated black plate so as to produce a corrosion-resistant conversion coating. After application of the aqueous treatment solution, drying takes place so as to produce a dry coating layer of the treatment solution on the black plate surface, with drying being carried out in a furnace (coil dryer) at drying temperatures in the range of 50° C. to 250° C. In the method according to the present invention, it was found useful to ensure that the drying temperature is lower than 200° C. and the drying time used measured a maximum of 5 seconds.

For use as packaging steel, for example, in the production of food cans or beverage cans, this type of black plate is always coated with an organic coating in order to further increase the corrosion resistance of the black plate. In this manner, especially the inside surface of a food can or beverage can, which can come into contact with acidic products in the cans and therefore is especially at risk of corrosion, is protected against corrosion. Surprisingly, it was found that the adhesion of organic coatings to the black plate surface can be substantially improved if the black plate, prior to application of the organic coating, is subjected to a thermal treatment (heat treatment) within a specific working range. Depending on the length of the thermal treatment time used and the treatment temperature to which the black plate is heated during the thermal treatment, different qualities of adhesion of the organic coating to the black plate surface can be obtained.

In a preferred embodiment of the invention, to produce black plate coated with a conversion coating, a cold-rolled, annealed and temper-rolled steel coil (black plate) with a carbon content of 20 to 1,000 ppm is first passed through an alkaline electrolytic bath, with the black plate being connected as an anode, so as to produce a steel surface that is resistant to corrosion. After rinsing the black plate with water, using a no-rinse process, an aqueous treatment solution is applied to at least one black plate surface and subsequently dried so as to produce a dry coating layer of the treatment solution on the black plate surface. Drying preferably takes place while the black plate coil is moving and is carried out in a coil dryer at drying temperatures of a maximum of 200° C. and a drying time of a maximum of 5 seconds.

The treatment solution is preferably chromium-free and preferably comprises metal components selected from the group comprising Ti, Zr, Mn, Zn, P or combinations thereof, or organic components of polyacrylates and/or polycarboxylates. In an especially preferred implementation example, the treatment solution used is the commercially available substance known under the trade name GRANODINE® 1456, which contains Ti and Zr. As described in DE 10 2013 107 506 A1, however, other substances can also be used as the treatment solution.

Black plate coated in this manner with a GRANODINE® 1456-based conversion coating and having a dry coating layer with a surface coverage of approximately 10 mg/m$^2$ Ti on one black plate surface was paint-coated with other organic epoxy phenol- and polyester-based paints to obtain layers with a surface coating from 5-10 g/m$^2$ and was subsequently subjected to a heat treatment at varying parameters (varying lengths of treatment time and treatment temperatures) to study the quality of adhesion of the paint to the black plate as a function of the process parameters of the heat treatment.

By way of an example, FIG. 1 illustrates the adhesion of the paint to black plate coated with the GRANODINE® 1456 conversion coating, using two different processing methods. In a first processing method, the conversion-coated black plate was subjected to a long-time treatment (long-time drying) for a thermal treatment time of t=3 min at various treatment temperatures T (° C.). The adhesion of the paint to the black plate surface obtained at the different treatment temperatures during this long-time treatment was qualitatively determined and plotted in the diagram shown in FIG. 1. As the curve of long-time drying thereby obtained demonstrates, the adhesion of the paint reaches a peak at a treatment temperature T 150° C. and decreases at temperature below approximately 140° C. and above 140° C.

Likewise, the same black plate coated with a conversion coating and a paint coating was subjected to short-time drying for t<10 seconds at various treatment temperatures. Again, the resulting adhesion of the paint was qualitatively determined and plotted in the diagram shown in FIG. 1 as a function of the heat treatment temperature T (° C.). The curve of short-time treatment during a thermal treatment time of fewer than 10 seconds indicates that the curve reaches a comparatively sharp peak at a treatment temperature in the range of 280° C. to 300° C. and especially at approximately 288° C. Thus, the two curves in FIG. 1 demonstrate that as a function of the thermal treatment time t, the thermal treatment of black plate reaches an optimum treatment temperature T, at which optimum adhesion of the paint to the black plate surface is obtained.

Furthermore, surprisingly, it was not only found that, depending on the length of the thermal treatment time t, there is an optimum treatment temperature T, but also that the adhesion of paint reaches optimum values when black plate is subjected to a thermal treatment (heat treatment) within a predefined working range. It has in fact become apparent that excessively high treatment temperatures can cause overdrying of the conversion coating and that excessively low treatment temperatures can cause underdrying of the conversion coating. Both overdrying and underdrying the conversion coating entails the risk that when a mechanical load is applied to the paint-coated black plate, the conversion coating may become detached from the black plate surface, which in turn will cause the organic paint applied to the conversion coating to become detached from the black plate.

Figure 2A:
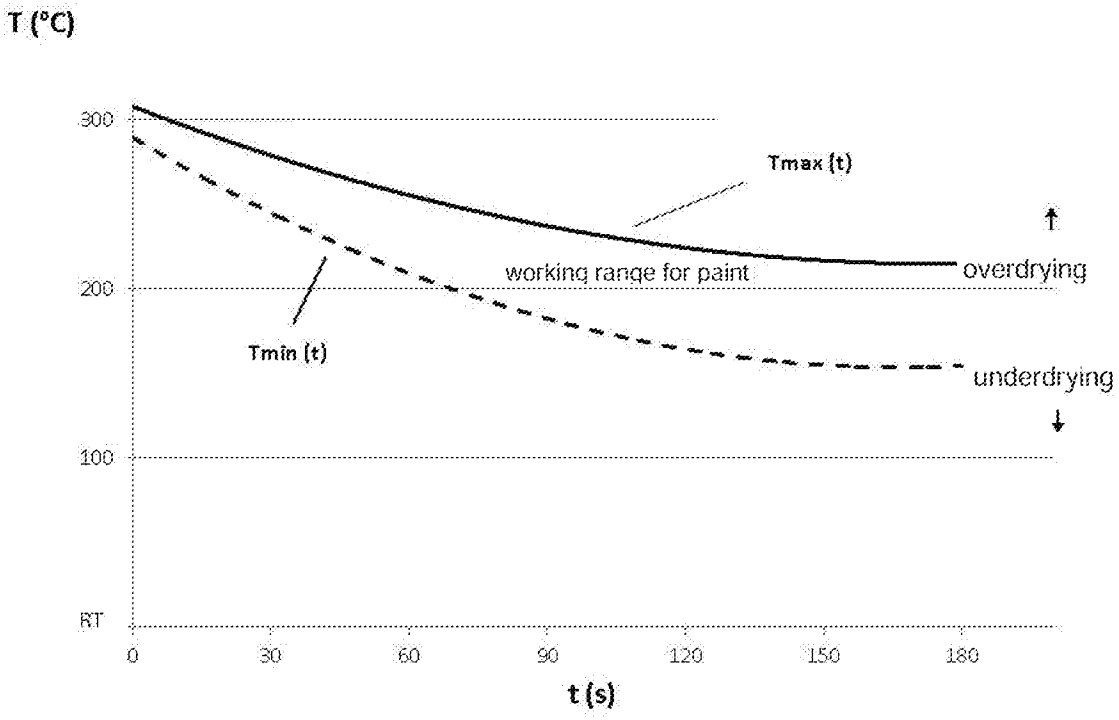
FIG. 2A: A graphical representation of the optimum working range of the heat treatment in a method of thermally treating (heat treating) black plate coated with a conversion coating prior to application of paint, in a temperature-time diagram (heat treatment temperature (T/° C.) as a function of the treatment time (t/sec))
Figure 2B:
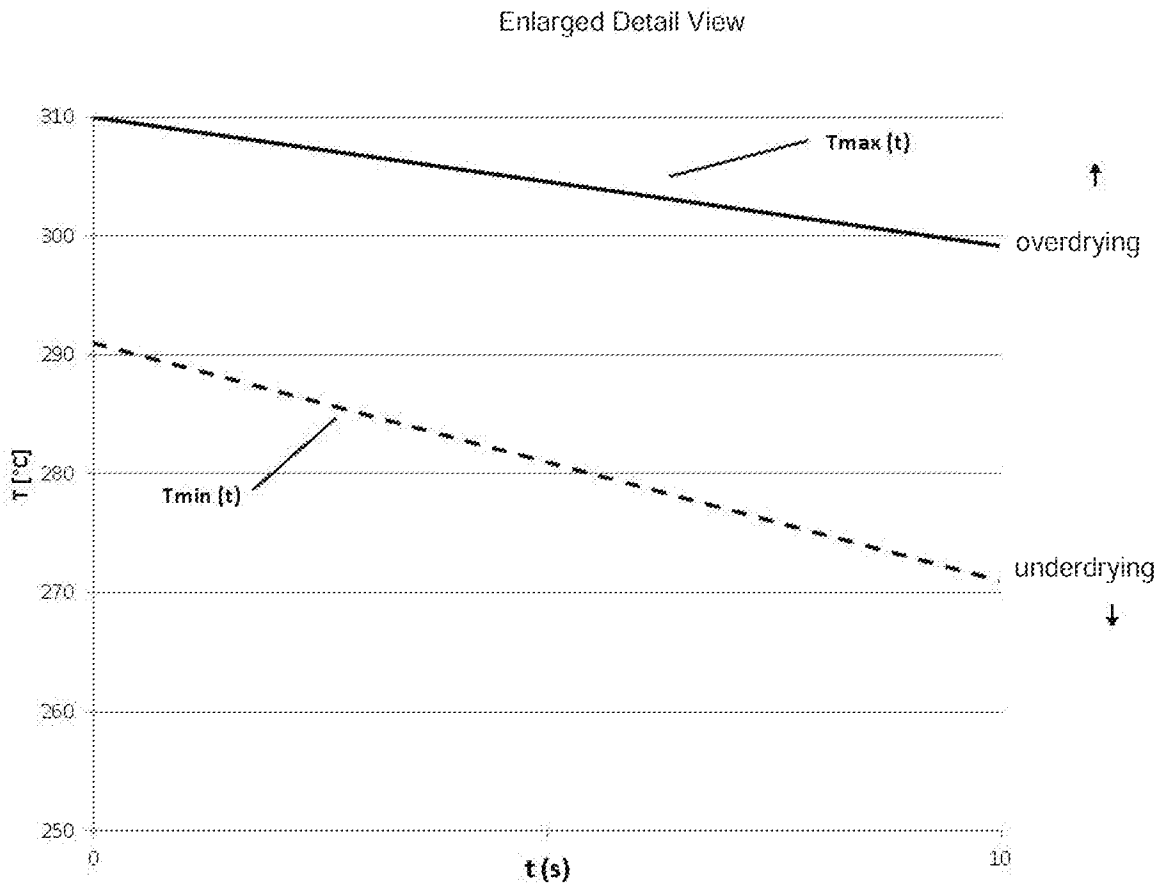
FIG. 2B: A detailed view of the graphical representation of the optimum working range of the heat treatment in a method of thermally treating (heat treating) black plate coated with a conversion coating prior to application of paint, in a temperature-time diagram (heat treatment temperature (T/° C.) as a function of the treatment time (t/sec)) up to 10 seconds.

In FIG. 2A, the optimum working range for a thermal treatment (heat treatment) of black plate is graphically plotted in a temperature-time diagram. The diagram in FIG. 2A shows the heat treatment temperature T (in ° C.) as a function of the length of the treatment time t (in seconds), with the detail view in FIG. 2B showing the short-time range from 0 to 10 seconds. As the diagram shown in FIGS. 2A and 2B indicate, there is an optimum working range in which the conversion coating on the black plate surface is neither underdried nor overdried. The working range is circumscribed by an (upper) curve of a maximum temperature Tmax (t) and a (lower) curve of a minimum temperature Tmin (t). Both the maximum temperature Tmax and the minimum temperature Tmin are dependent on the treatment time t, with both the maximum temperature Tmax and the minimum temperature Tmin decreasing as the length of the treatment time t increases. This means that during a longer treatment time t, a lower treatment temperature T can be used to carry out a thermal treatment within the optimum working range.

Application of an organic coating to black plate coated with a conversion coating is preferably carried out by means of coil coating. In this process, black plate in coil form is moved at a coil speed of preferably more than 30 m/min and up to 200 m/min and, while the coil is moving, is coated with an organic coating, for example, paint or a polymer coating. The organic coating can be applied, for example, by spraying an organic paint, in particular an Organosol- or epoxy phenol-based paint or a mixture thereof onto the surface. As an alternative, the organic coating can also be applied by laminating a polymer film, in particular a PET, PP or PE film, or by directly extruding a molten thermoplastic synthetic material (especially PP or PE) onto one or both black plate surfaces.

Since application of the organic coating to the conversion coating of black plate is preferably carried out by coil coating at high coil speeds of preferably more than 30 m/min, the thermal treatment according to the present invention is preferably carried out while the black plate coil is moving. The thermal treatment takes place in a furnace, for example, a floating furnace or an induction furnace that has a predefined (and circumscribed) length and thus a circumscribed throughput path length. As a result, the thermal treatment can be carried out only within a circumscribed treatment path length (and a circumscribed length of treatment time t). This means that at the high coil speeds prevailing in coil coating, preferably only a short-time thermal treatment in the range of seconds can be carried out if the thermal treatment is to take place while the coil is moving.

As the short-time range of $0 \leq t \leq 60$ seconds in FIG. 2A indicates, the treatment temperatures T within the optimum working range are between approximately 180° C. and 310° C. In the range of a treatment time of $0 \leq t \leq 10$ seconds, the treatment temperatures in the optimum working range are between approximately 270° C. and 310° C., which is especially evident in the enlarged detail view of FIG. 2B.

In the short-time treatment range of $0 \leq t \leq 10$ seconds, in which the thermal treatment is preferably carried out in the coil coating process, the curve of the maximum temperature Tmax (t), which limits the optimum working range upwards, can be approximately described by a first-degree polynomial as follows:

$$T\max(t)=310^\circ\ \text{C.}-t(^\circ\ \text{C./s}).$$

In the short-time treatment range of $0 \leq t \leq 10$ seconds, the minimum temperature Tmin, which limits the optimum working range downwards, as a function of the length of treatment time t can be approximately described by a linear function as follows:

$$\text{Tmin}(t)=290^\circ\ \text{C.}-2t*(^\circ\ \text{C./s}),$$ where t stands for the length of treatment time.

In a process for the production of black plate coated with a conversion coating and an organic coating, the thermal treatment according to the present invention can be carried out prior to, during or after application of the organic coating to the conversion coating. In addition, the thermal treatment can also be carried out in several steps or stages.

Figure 4:
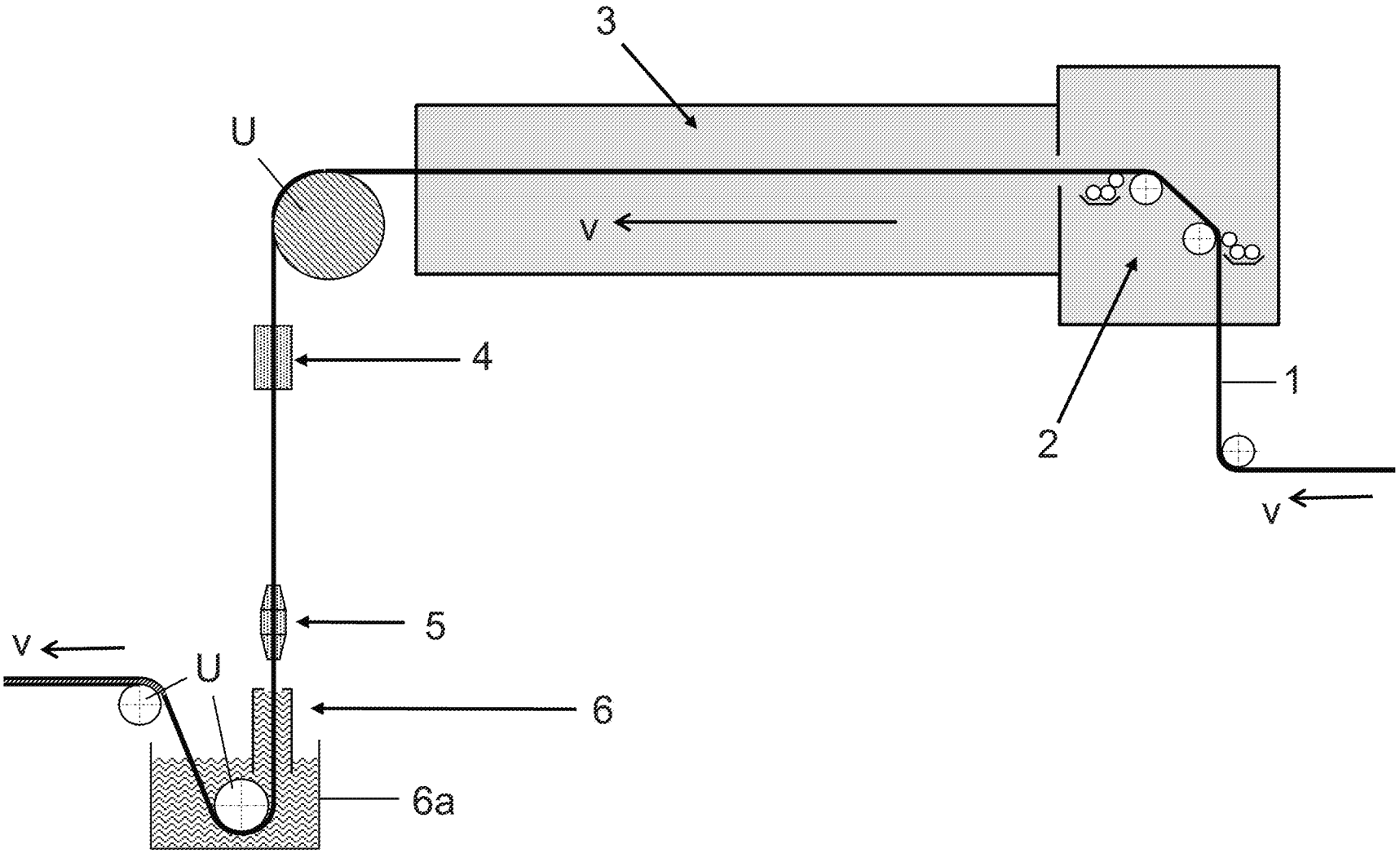
FIG. 4: A schematic representation of a coating line for application of paint to the conversion coating of black plate coated with the conversion coating [sic] and for carrying out a heat treatment of the paint-coated black plate according to the present invention.

To illustrate this, the use of the treatment method according to the present invention in a process for the production of black plate coated with a conversion coating or an organic paint will be described below with reference to FIG. 4:

FIG. 4 shows a diagrammatic representation of a coating line in which paint is applied to the conversion coating of black plate coated with the conversion coating and in which a heat treatment of paint-coated black plate according to the present invention is carried out. Conversion-coating black plate in the form of a coil is fed to the coating line at a predefined coil speed v. The coil speed v is preferably in a range from 30 to 60 m/min. The black plate coil 1 is first introduced into a coating line 2, in which an organic paint is applied to at least one surface of the black plate coil, using a coil coating process. After application of the paint, the paint is dried. To this end, the black plate coil 1 is passed at the coil speed through a floating furnace 3 in which the black plate coil 1 is heated during a paint drying time in the range of 10 to 15 seconds (depending on the coil speed v set) to a paint drying temperature of a maximum of 240° C. and especially of approximately 200 to 220° C.

After the paint has dried, the paint-coated black plate coil 1 is subjected to a heat treatment according to the present invention. To this end, a first induction furnace 4 is disposed downstream of the floating furnace 3. This induction furnace (compared to the floating furnace 3) has a short throughput path length. The paint-coated black plate coil 1 is routed via the deflection roller U out of the floating furnace 3 and into the first induction furnace 4 in which it is heated for a brief period of time, i.e., within a treatment time of less than 1 second and preferably less than approximately 0.5 seconds, to a temperature in the range of 240° C. to 280° C.

Optionally, a second induction furnace 5 can be disposed downstream of the first induction furnace 4 in the direction of the coil, in which second induction furnace the black plate coil 1 can be subjected to a further heat treatment. In the second induction furnace 5, the black plate coil 1 can be heated, for example, during a treatment time of less than 1 second and preferably less than approximately 0.3 seconds to a temperature in the range of 280° C. to 310° C.

After the heat treatment, the paint-coated black plate coil 1 is cooled in a cooling system 6 by introducing it, for example, into a container 6*a* which is filled with a cooling fluid (for example, water) and by subsequently routing it out of the container via deflection rollers U. The black plate coil 1 is dried at room temperature.

The treatment method according to the present invention can also be used in a process for the production of black plate which is coated with a conversion coating and a polymer coating.

When applying an organic thermoplastic polymer coating to the surface of conversion-coated black plate, it is recommended that a temperature above the melting temperature of the polymer be maintained in order to keep the thermoplastic polymer material during application in a molten state or to heat-soften a polymer film (e.g., a PET film). The melting temperature of PET, for example, is approximately 240° C., which is why, during lamination of a PET film onto the conversion-coated black plate surface, e.g., black plate, during lamination of the PET film in the coil coating process, is kept at temperatures above 240° C. in order to heat-soften the PET film.

Figure 3:
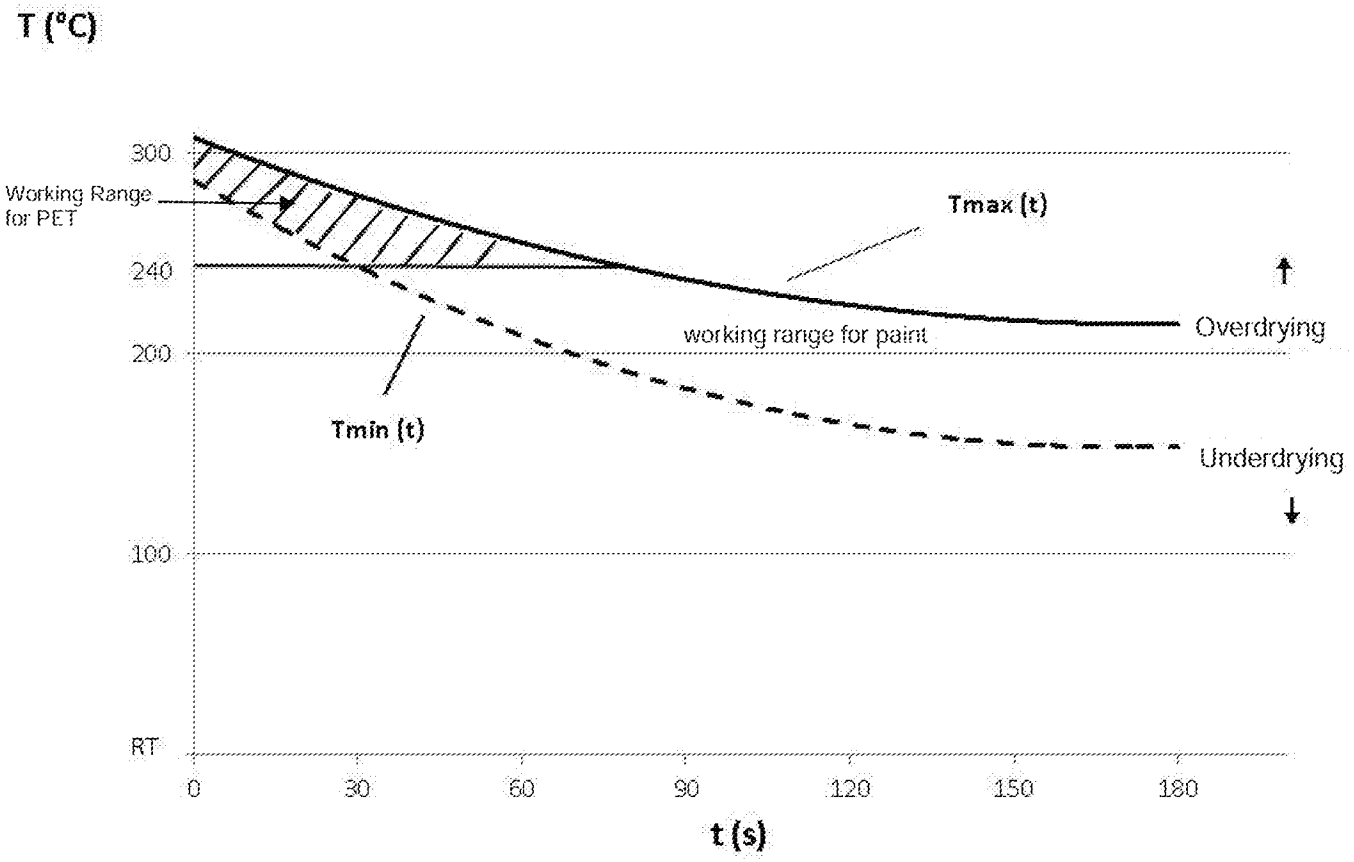
FIG. 3: A graphical representation of the optimum working range of the heat treatment in a method of thermally treating (heat treating) black plate coated with a conversion coating prior to application of a PET film, in a temperature-time diagram (heat treatment temperature (T in ° C.) as a function of the treatment time (tin seconds))

In the diagram shown in FIG. 3, which conforms to the diagram shown in FIG. 2, the melting temperature of PET is drawn in (240° C.). Thus, when applying a PET polymer coating, the optimum working range (indicated by the hatch marks in the diagram) lies above the PET melting temperature of approximately 240° C. and under the time trend curve of the maximum temperature Tmax (t), as shown in FIG. 3. The thermal treatment of conversion-coated black plate is preferably carried out in a first step prior to the lamination of the PET film at temperatures of T>240° C., preferably T≈280° C., and in second step after lamination of the PET film at temperatures of T>300° C., preferably of T≈310° C., with the treatment time t in the first step preferably being approximately 0.3 seconds and in the second step preferably being approximately 0.2 seconds.

Figure 5:
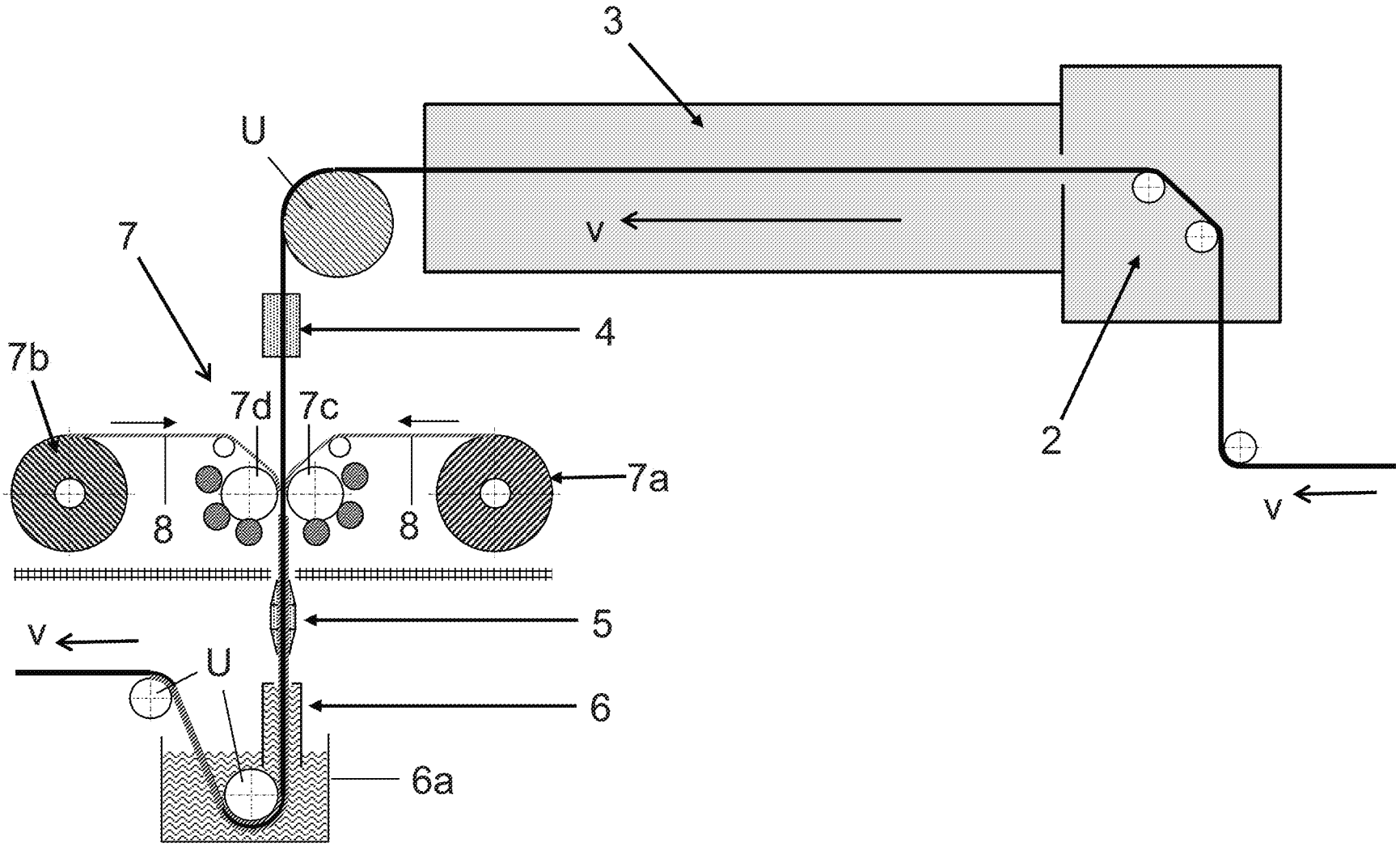
FIG. 5: A schematic representation of a coating line for application of a PET coating to the conversion coating of black plate coated with a conversion coating and for carrying out a heat treatment of black plate according to the present invention.

With reference to FIG. 5, an implementation example of the use of the treatment method according to the present invention will be described in a process for the production of black plate coated with a conversion coating and a PET film:

FIG. 5 shows a coating line for applying a PET coating to the conversion coating of conversion-coated black plate, in which a heat treatment of black plate according to the present invention can be carried out. The PET coating is laminated in the form of a PET film onto one or both surfaces of the black plate coil. To this end, the black plate coil 1 which is coated with a conversion coating is passed through a floating furnace 3 at a coil speed v in the range of 90 to 200 m/min and especially at a speed of approximately 150 m/min and preheated during a treatment time of fewer than 10 seconds to a temperature in the range of approximately 200° C. to 240° C.

After preheating, the conversion-coated black plate coil 1 is subjected to a heat treatment according to the present invention. To this end, the black plate coil 1 is routed via a deflection roller U out of the floating furnace 3 and into a first induction furnace 4 which is disposed downstream of the floating furnace 3. In the first induction furnace 4, the black plate coil is heated for a brief period of time, i.e., (depending on the coil speed set) during a treatment time of less than 1 second and preferably less than approximately 0.5 seconds and, for example, for approximately 0.3 seconds, to a temperature in the range of 240° C. to 280° C. The lower temperature limit of approximately 240° C. is equivalent to the melting temperature of PET.

Thereafter, the black plate coil 1 which has been heated to a temperature above the melting temperature of PET is fed into a laminator 7 in which a PET film 8 is laminated onto one or both surfaces of the black plate coil 1. In the implementation example illustrated, the laminator 7 comprises two rollers 7*a*, 7*b* with a PET film 8 wound around the rollers so as to laminate both surfaces of the black plate coil 1. The PET film 8 is drawn off the rollers 7*a*, 7*b* and routed via deflecting rollers to the respective surface of the black plate coil 1, onto which surface the film is pressed by the laminating rollers 7*c*, 7*d*. Since the black plate coil 1 has been heated, the PET film is at least partially heat-softened as it is being pressed onto the surface of the black plate coil 1 and adheres to said surface.

Downstream of the laminator 7, a second induction furnace 5 is disposed in which the black plate coil 1 can be subjected to a further heat treatment. In the second induction furnace 5, the black plate coil 1 is heated for a very short time during a treatment time of fewer than 0.5 seconds and preferably for approximately 0.1 to 0.3 seconds to a temperature in the range of 280° C. to 310° C. Because of the short heating time after the lamination, the heat treatment does not have a negative effect on the PET film 8, despite the fact that during the course of this heat treatment the black plate coil 1 is heated to temperatures above the melting temperature of PET.

After the heat treatment, the paint-coated black plate coil 1 is once again routed into a cooling system 6 in order to cool the black plate coil 1 to room temperature.

The equipment components of the coating lines shown in FIGS. 4 and 5 can also be combined to form a single line in such a manner that the black plate coil 1 can be coated with paint on one surface and with a PET coating on the other surface. In this case, the coating device 2 (as shown in FIG. 4) is disposed upstream of the floating furnace 3, and the laminator 7 (as shown in FIG. 5) is disposed downstream of the floating furnace 5 [sic; 3] and upstream of the cooling system, and the two inductions furnaces 4, 5 are respectively disposed upstream and downstream of the laminator 7 (as shown in FIG. 5).

The invention makes it possible to improve the adhesion of organic coatings to conversion-coated black plate in the coil coating process, with a thermal treatment within a predefined working range in the temperature-time diagram being carried out while the black plate coil is moving, either prior to, during or after application of the organic coating. During short treatment times t, which are preferably carried out at high coil speeds of more than 30 m/min in the coil coating process and which are preferably in the range of 0.1 seconds to 60 seconds and most preferably in the range of 0≤t≤10 seconds, the optimum working range is at treatment temperatures in the range of 180° C. to 310° C. and, during the preferred short treatment times in the range of 0≤t≤10 seconds, in the temperature range from 270° C. to 310° C. The invention can be very advantageously used in combination with a process for the production of black plate which is coated with a chromium-free conversion coating, such as described in DE 10 2013 107 506 A1. As a result, the invention can utilize the advantages of a chromium-free, and thus environmentally friendly and health-compatible, conversion coating on black plate. When the method according to the present invention is combined with the process for the production of black plate which is coated with a chromium-free conversion coating, it is possible to produce highly corrosion-resistant black plate for use as packaging steel in an environmentally friendly and health-compatible way, with the thereby produced black plate ensuring excellent adhesion of organic coatings to the black plate surface and thus allowing the forming of black plate, for example, using a deep drawing or ironing process, without the risk that the conversion coating or the organic coating may become detached.

What is claimed is:

1. A method of thermally treating black plate coated with a chromium-free conversion coating so as to improve the adhesion of the conversion coating, wherein the black plate coated with the conversion coating is heated during a thermal treatment time (t) ranging from 0.1 seconds to 30 seconds to a temperature (T) in the range of 280° C. to 320° C. and within a working range defined in a temperature-time-diagram by the profile of a maximum temperature Tmax(t) and a minimum temperature Tmin(t), the profile being dependent on the treatment time t, and the time profile of the maximum temperature Tmax(t) and the minimum temperature Tmin(t) being continuously decreasing as the treatment time (t) is increasing.

2. The method of claim 1, wherein the thermal treatment time fS) is in the range of 0.1 seconds to 10 seconds, and the black plate is heated during this treatment time to a temperature in the range of 290° C. to 310° C.

3. The method of claim 1, wherein the profile of the maximum temperature Tmax(t) and/or the minimum temperature Tmin(t) is approximately linear at least in the range of $0 \leq t \leq 10$ seconds.

4. The method of claim 1, wherein in the range of $0 \leq t \leq 10$ seconds, the profile of the maximum temperature Tmax(t) conforms at least approximately to the equation $$T\max(t)=310^\circ\ \text{C.}-t^*(^\circ\ \text{C./s}),$$

where t denotes the treatment time.

5. The method of claim 4, wherein in the range of 0 t 10 seconds, the profile of the minimum temperature Tmin(t) conforms at least approximately to the equation $$T\min(t)=290^\circ\ \text{C.}-at^*(^\circ\ \text{C./s}),$$

where t denotes the treatment time and a=2.

6. A method for the production of corrosion-protected black plate, the method comprising:

applying a chromium-free conversion coating to at least one surface of the black plate; and thermally treating the black plate coated with the conversion coating so as improve the adhesion of the conversion coating, wherein the black plate coated with the conversion coating is heated during this thermal treatment for a time (t) ranging from 0.1 seconds to 30 seconds to a temperature (T) in the range of 280° C. to 320° C. and within a working range defined in a temperature-time-diagram by the profile of a maximum temperature Tmax(t) and a minimum temperature Tmin (t), the profile being dependent on the treatment time t, and the time profile of the maximum temperature Tmax(t) and the minimum temperature Tmin(t) being continuously decreasing as the treatment time (t) is increasing.

7. The method of claim 6, wherein applying the chromium-free conversion coating to at least one surface of the black plate comprises:

electrochemically treating the black plate by passing the black plate through an electrolytic bath so as to produce a steel surface which is inert to oxidation;

rinsing the black plate; and applying a chromium-free treatment solution to at least one surface of the black plate so as to produce the conversion coating.

8. The method of claim 7, wherein the treatment solution applied to the surface of the black plate so as to produce the conversion coating is dried by heating the black plate, to which the treatment solution has been applied, during a drying time of a maximum of 5 seconds to a drying temperature of a maximum of 200° C.

9. The method of claim 6, wherein prior to, during or after the thermal treatment, an organic coating is applied to the conversion coating.

10. The method of claim 8, wherein after the treatment solution has been dried, the black plate is paint-coated with an organic paint on at least one surface and the applied paint is heated in a paint drying step by heating the paint-coated black plate during a paint drying time of a maximum of 15 seconds to a paint drying temperature of a maximum of 240° C.

11. The method of claim 10, wherein after the paint has been dried, the paint-coated black plate is subjected to a thermal treatment by heating the paint-coated black plate in an induction furnace during a treatment time of 0.1 to 1 second to temperatures in the range of 290° C. to 310° C.

12. The method of claim 9, wherein the organic coating is produced by paint-coating with an Organosol-, epoxy phenol-, or polyester-based paint, or by coating with PE, PP, or PET.

13. The method of claim 9, wherein the organic coating is applied by laminating a polymer film, or directly extruding a molten thermoplastic synthetic material onto one or both surfaces of the black plate.

14. The method of claim 13, wherein prior to application of the organic coating, the black plate coated with the conversion coating is heated during a treatment time from 0.1 seconds to 1 second to temperatures in the range of 280° C. to 290° C.

15. The method of claim 6, wherein the black plate has the form of a coil which is moved at a coil speed of at least 30 m/min during application of the conversion coating and/or during the thermal treatment.

16. The method of claim 1, wherein the thermal treatment time is in the range of 0.1 seconds to 1 second.

17. The method of claim 2, wherein the thermal treatment time is in the range of 0.1 seconds to 0.5 seconds.

18. A method for the production of corrosion-protected black plate, the method comprising:

applying a chromium-free conversion coating to at least one surface of the black plate; and thermally treating the black plate coated with the conversion coating so as improve the adhesion of the conversion coating, the black plate coated with the conversion coating being heated during this thermal treatment for a time from 0.1 seconds to 30 seconds to a temperature in the range of 280° C. to 320° C., wherein prior to, during or after the thermal treatment, an organic coating is applied to the conversion coating, prior to application of the organic coating, the black plate coated with the conversion coating is heated during a treatment time from 0.1 seconds to 1 second to a temperature in the range of 280° C. to 290° C., and after application of the organic coating, the black plate coated with a conversion coating is heated during a treatment time from 0.1 seconds to 0.5 seconds to a temperature in the range of 290° C. to 310° C.

19. The method of claim 6, wherein during or after the thermal treatment, an organic coating is applied to the conversion coating, and after the thermal treatment and application of the organic coating, the black plate coated with a conversion coating is heated during a treatment time from 0.1 seconds to 0.5 seconds to a temperature in the range of 280° C. to 310° C.

20. The method of claim 6, wherein the thermal treatment time is in the range of 0.1 seconds to 1 second, after the thermal treatment, an organic coating is applied to the conversion coating, and after application of the organic coating, the black plate coated with a conversion coating is heated during a treatment time from 0.1 seconds to 0.5 seconds to a temperature in the range of 280° C. to 310° C.

* * * * *